US006767255B1

(12) United States Patent
Croswell

(10) Patent No.: US 6,767,255 B1
(45) Date of Patent: Jul. 27, 2004

(54) TEMPORARY POWER OUTLET ADAPTER

(76) Inventor: Del W. Croswell, 10323 Caminito Aralia #80, San Diego, CA (US) 92131

( * ) Notice: Subject to any disclaimer, the term of this patent is extended or adjusted under 35 U.S.C. 154(b) by 0 days.

(21) Appl. No.: 10/428,395

(22) Filed: May 3, 2003

(51) Int. Cl.[7] ..... H01R 25/00
(52) U.S. Cl. ..... 439/651; 439/505; 439/106
(58) Field of Search ..... 439/505, 641–653, 439/106–107

(56) References Cited

U.S. PATENT DOCUMENTS 4,904,195 A * 2/1990 Thackeray ..... 439/173
5,035,630 A * 7/1991 Norsworthy ..... 439/92
5,234,360 A * 8/1993 Kramer, Jr. ..... 439/505
5,344,333 A * 9/1994 Haag ..... 439/320
6,435,732 B1 * 8/2002 Asao et al. ..... 385/78
6,644,987 B2 * 11/2003 Meleck ..... 439/107

* cited by examiner

*Primary Examiner*—Truc Nguyen

(57) ABSTRACT

A temporary power outlet adapter for use with temporary power distribution boxes comprising a twist type male power coupling that is electrically connectable to a conventional temporary power distribution box. A splitter is electrically connected to the twist type male power coupling. A household power outlet is electrically connected to the splitter.

20 Claims, 3 Drawing Sheets

TEMPORARY POWER OUTLET ADAPTER

BACKGROUND OF THE INVENTION

1. Field of the Invention

The present invention relates to a temporary power outlet adapter for use in connection with extension cords. The temporary power outlet adapter has particular utility in connection with a temporary power outlet adapter having an integral household outlet.

2. Description of the Prior Art

Temporary power outlet adapters are desirable for use at a work site with a power distribution box to allow electrical distribution to those that are building a house. Currently, temporary power outlet adapters do not have household outlets like those needed for rechargers. A need was felt for a temporary power outlet adapter that would have an integral household outlet therein.

The use of extension cords is known in the prior art. For example, U.S. Pat. No. 5,236,374 to Leonard et al. discloses an extension cord with multiple receptacles having an electric wire with a first end, a second end, and a make plug coupled to the first end and a method for forming same. A fuse is coupled to the wire. Multiple receptacle blocks are coupled to the wire at spaced intervals along the wire. One of the receptacle blocks is coupled to the second end of the wire. Each of the receptacle blocks has several pairs of slots for receiving male plugs of items to be powered by the extension cord. However, the Leonard et al. '374 patent does not have a temporary power outlet adapter having an integral household outlet.

Similarly, U.S. Pat. No. 5,902,148 to O'Rourke discloses an extension cord having multiple female sockets which are attached to two or more conducting wires. In one embodiment of the invention, the cord has three or more conducting wires with two or more female sockets attached to the conducting wires. Each of the female sockets is attached to two of the conducting wires and each conducting wire is attached to at least one female socket. This may provide an extension cord having two or more electrically isolated circuits. Alternatively, or in addition, the cord may be configured to provide groups of female sockets each with different voltage ratings. In another embodiment of the invention, the cord has multiple socket blocks attached to the cord; each socket block housing one or more of the female sockets. A moving member is attached to each of the socket blocks so that the cord may be fastened or held by an external object. However, the O'Rourke '148 patent does not have a temporary power outlet adapter having an integral household outlet.

Lastly, U.S. Pat. No. 5,234,360 to Kramer, Jr. discloses a flexible electric extension cord having a main cable with a plug connected at one end and a socket connected at the other end. A plurality of flexible pigtails connected at spaced intervals along the main cable and having a socket connected to the free end. The extension cord is utilized to conduct electricity to electricity consuming devices which are connected to the sockets. However, the Kramer, Jr. '360 patent does not have a temporary power outlet adapter having an integral household outlet.

While the above-described devices fulfill their respective, particular objectives and requirements, the aforementioned patents do not describe a temporary power outlet adapter that allows a temporary power outlet adapter having an integral household outlet. The Leonard et al. '374, O'Rourke '148 and Kramer, J. '360 patents make no provision a temporary power outlet adapter having an integral household outlet.

Therefore, a need exists for a new and improved temporary power outlet adapter which can be used for a temporary power outlet adapter having an integral household outlet. In this regard, the present invention substantially fulfills this need.

In this respect, the temporary power outlet adapter according to the present invention substantially departs from the conventional concepts and designs of the prior art, and in doing so provides an apparatus primarily developed for the purpose of a temporary power outlet adapter having an integral household outlet.

SUMMARY OF THE INVENTION

In view of the foregoing disadvantages inherent in the known types of extension cords now present in the prior art, the present invention provides an improved temporary power outlet adapter, and overcomes the above-mentioned disadvantages and drawbacks of the prior art. As such, the general purpose of the present invention, which will be described subsequently in greater detail, is to provide a new and improved temporary power outlet adapter and method which has all the advantages of the prior art mentioned heretofore and many novel features that result in a temporary power outlet adapter which is not anticipated, rendered obvious, suggested, or even implied by the prior art, either alone or in any combination thereof.

To attain this, the present invention essentially comprises a twist type male power coupling that is electrically connectable to a conventional temporary power distribution box. A splitter is electrically connected to the twist type male power coupling. A household power outlet is electrically connected to the splitter.

There has thus been outlined, rather broadly, the more important features of the invention in order that the detailed description thereof that follows may be better understood and in order that the present contribution to the art may be better appreciated.

The invention may also include a w type splitter, a first power outlet coupling and a second power outlet coupling. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved temporary power outlet adapter that has all of the advantages of the prior art extension cords and none of the disadvantages.

It is another object of the present invention to provide a new and improved temporary power outlet adapter that may be easily and efficiently manufactured and marketed.

An even further object of the present invention is to provide a new and improved temporary power outlet adapter that has a low cost of manufacture with regard to both materials and labor, and which accordingly is then susceptible of low prices of sale to the consuming public, thereby making such temporary power outlet adapter economically available to the buying public.

Still another object of the present invention is to provide a new temporary power outlet adapter that provides in the apparatuses and methods of the prior art some of the advantages thereof, while simultaneously overcoming some of the disadvantages normally associated therewith.

Lastly, it is an object of the present invention is to provide a temporary power outlet adapter for a temporary power outlet adapter having an integral household outlet.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
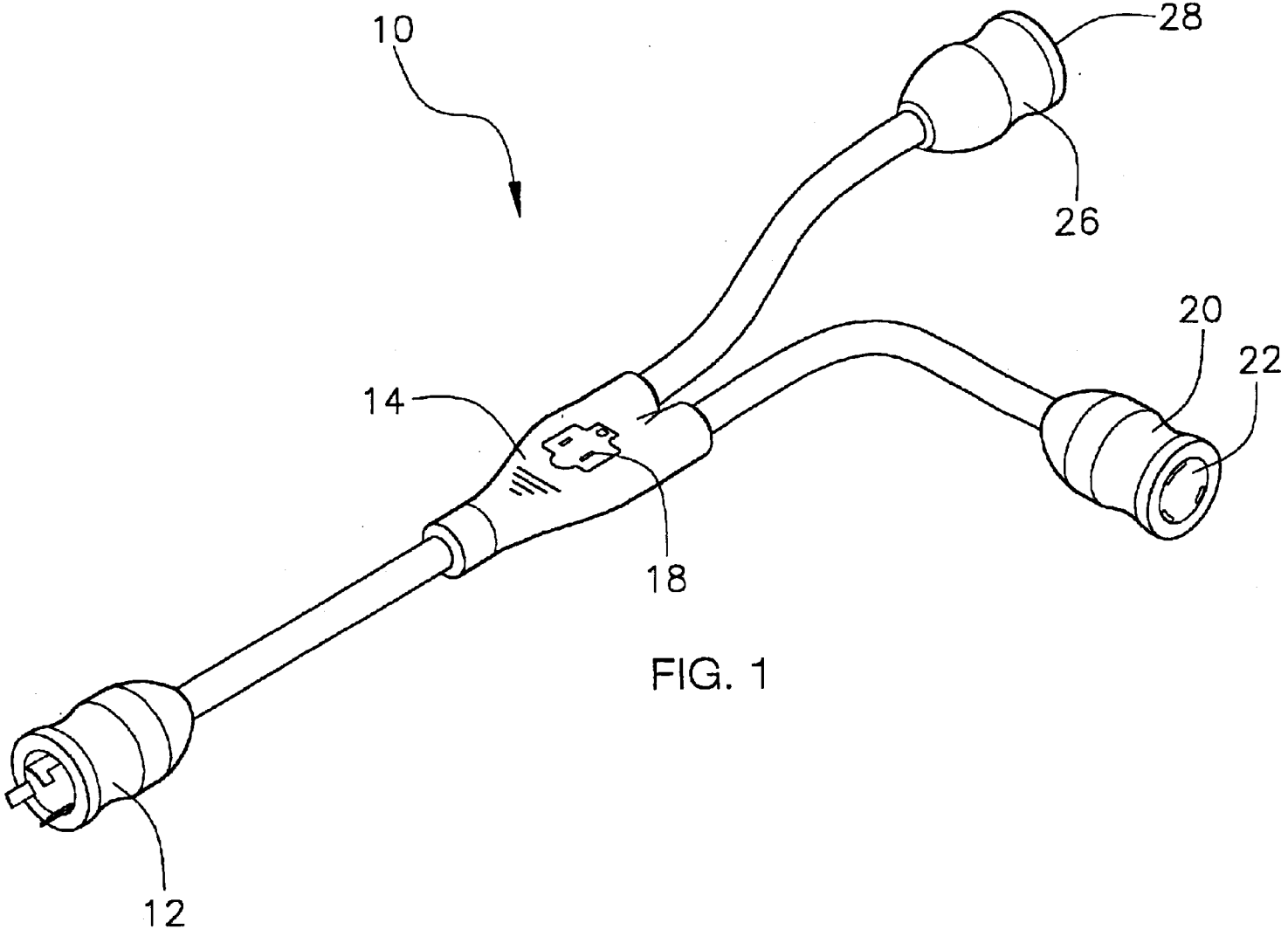
FIG. 1 is a top perspective view of the preferred embodiment of the temporary power outlet adapter constructed in accordance with the principles of the present invention.
Figure 2:
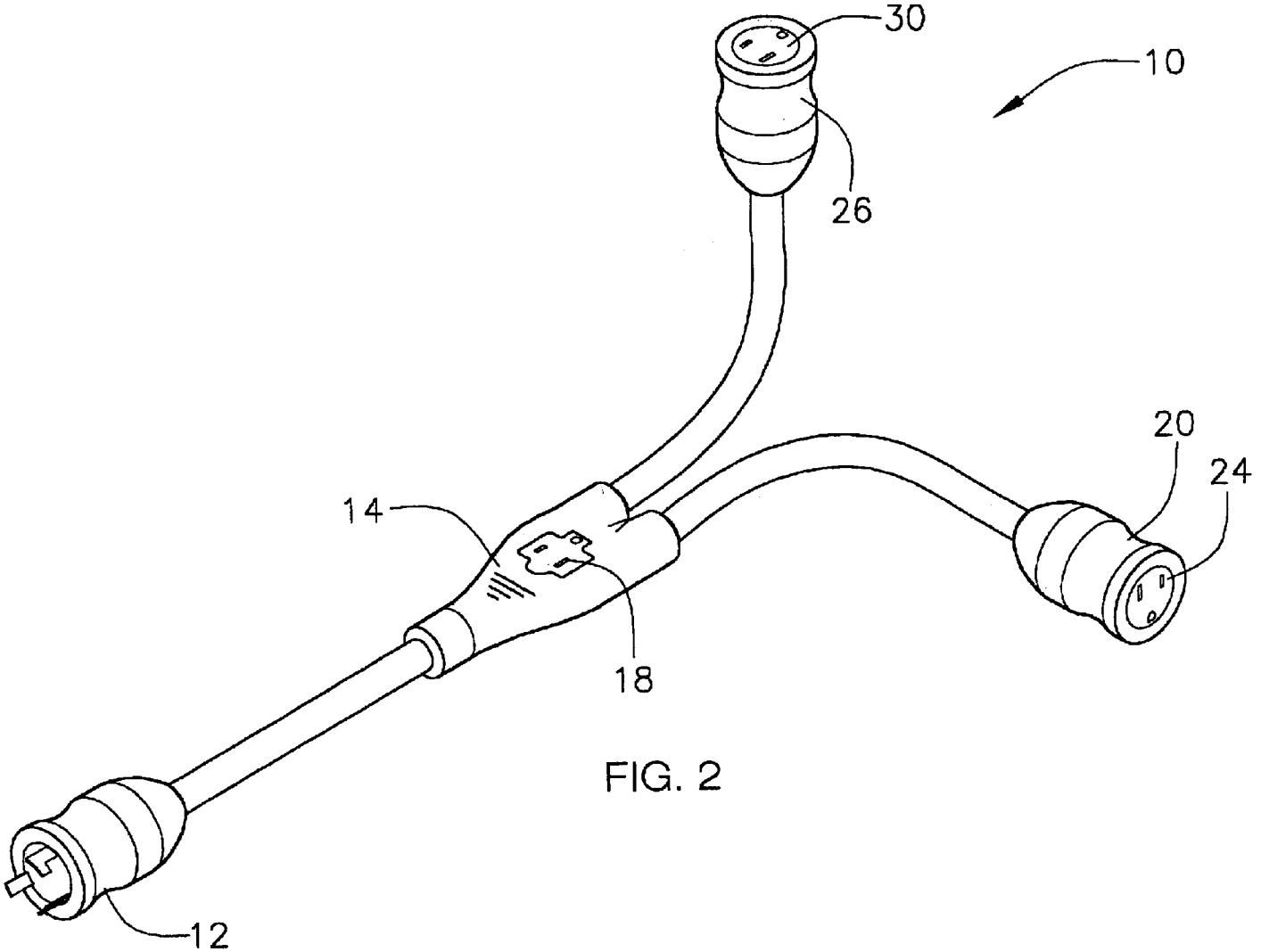
FIG. 2 is a top perspective view of the temporary power outlet adapter of the present invention.
Figure 3:
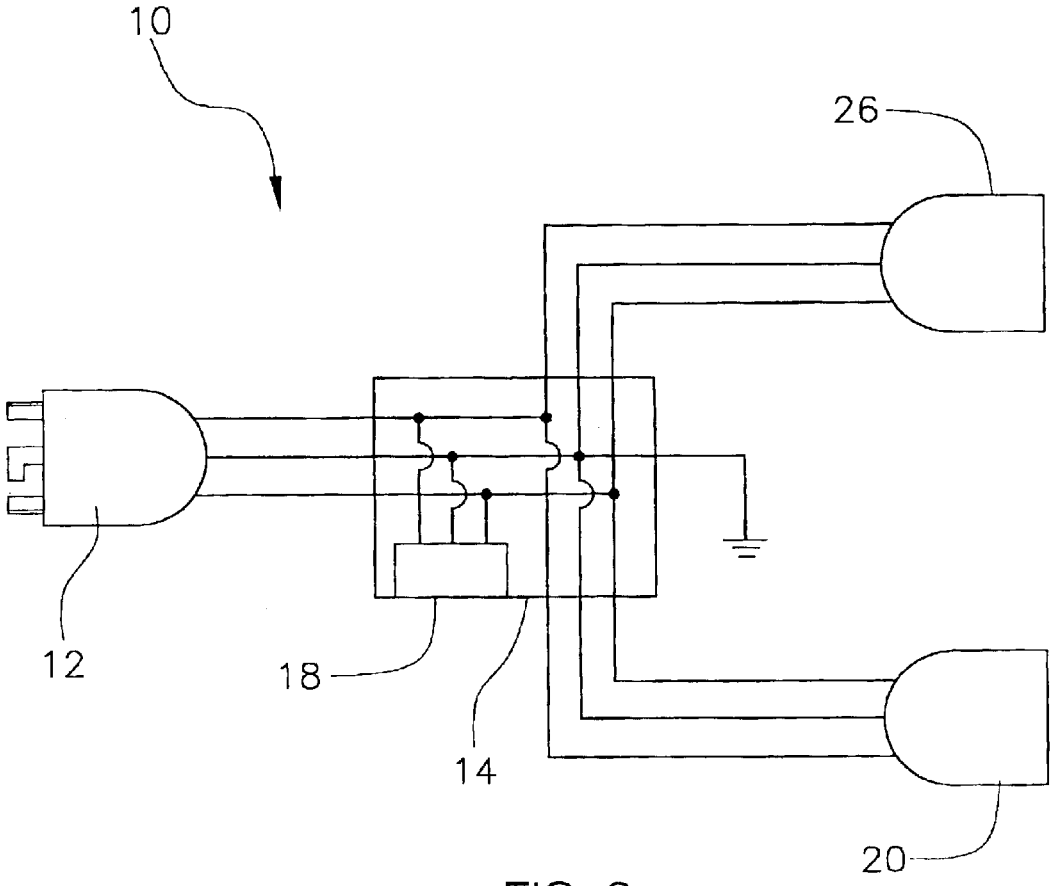
FIG. 3 is a wiring diagram view of the temporary power outlet adapter of the present invention.

Referring now to the drawings, and particularly to FIGS. 1–3, a preferred embodiment of the temporary power outlet adapter of the present invention is shown and generally designated by the reference numeral 10.

In FIG. 1, a new and improved temporary power outlet adapter 10 of the present invention for a temporary power outlet adapter having an integral household outlet is illustrated and will be described. More particularly, the temporary power outlet adapter 10 has a twist type male power coupling 12 that is electrically connectable to the conventional temporary power distribution box. A splitter 14 is electrically connected to the twist type male power coupling 12. A household power outlet 18 is integral to the splitter 14. The splitter 14 forms the Y split in the present example, but may form a W split 16 (not shown) in other embodiments. The household power outlet 18 is electrically connected to the splitter 14. The household power outlet 18 is of the three prong 125 volt, 15 amp type. A first power outlet coupling 20 is electrically connected to the splitter 14, and is a twist type female connector 22. A second power outlet coupling 26 is electrically connected to the splitter 14 and is a twist type female connector 28.

In FIG. 2, the temporary power outlet adapter 10 is illustrated and will be described. More particularly, the temporary power outlet adapter 10 has the twist type male power coupling 12 that is electrically connectable to the conventional temporary power distribution box. The splitter 14 is electrically connected to the twist type male power coupling 12. The household power outlet 18 is integral to the splitter 14. The splitter 14 forms the Y split. The household power outlet 18 is electrically connected to the splitter 14. The first power outlet coupling 20 is electrically connected to the splitter 14, and is a three prong type female connector 24. The second power outlet coupling 26 is electrically connected to the splitter 14 and is a three prong type female connector 30.

In FIG. 3, the temporary power outlet adapter 10 is illustrated and will be described. More particularly, the temporary power outlet adapter 10 has the twist type male power coupling 12 that is electrically connectable to the conventional temporary power distribution box. The splitter 14 is electrically connected to the twist type male power coupling 12. The household power outlet 18 is integral to the splitter 14. The splitter 14 forms the Y split. The household power outlet 18 is electrically connected to the splitter 14. The first power outlet coupling 20 is electrically connected to the splitter 14. The second power outlet coupling 26 is electrically connected to the splitter 14.

While a preferred embodiment of the temporary power outlet adapter has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic may be used instead of the rubber described. And although a temporary power outlet adapter having an integral household outlet have been described, it should be appreciated that the temporary power outlet adapter herein described is also suitable for use in other types of power adapters.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A temporary power outlet adapter comprising:

a twist type male power coupling that is electrically connectable to a conventional temporary power distribution box;

a splitter electrically connected to said twist type male power coupling; and a household power outlet electrically connected to said splitter.

2. The temporary power outlet adapter of claim 1 wherein:

said household power outlet is integral to said splitter.

3. The temporary power outlet adapter of claim 1 further comprising:

a first power outlet coupling electrically connected to said splitter.

4. The temporary power outlet adapter of claim 3 wherein:

said first power outlet coupling is a twist type female connector.

5. The temporary power outlet adapter of claim 3 wherein:

said first power outlet coupling is a three prong female connector.

6. The temporary power outlet adapter of claim 1 further comprising:

a second power outlet coupling electrically connected to said splitter.

7. The temporary power outlet adapter of claim 6 wherein:

said second power outlet coupling is a twist type female connector.

8. The temporary power outlet adapter of claim 6 wherein:

said second power outlet coupling is a three prong female connector.

9. The temporary power outlet adapter of claim 1 wherein:

said splitter forms a Y split.

10. The temporary power outlet adapter of claim 1 wherein:

said splitter forms a W split.

11. A temporary power outlet adapter comprising:

a twist type male power coupling that is electrically connectable to a conventional temporary power distribution box;

a splitter electrically connected to said twist type male power coupling; and a household power outlet electrically connected to said splitter;

wherein said household power outlet is integral to said splitter.

12. The temporary power outlet adapter of claim 11 further comprising:

a first power outlet coupling electrically connected to said splitter.

13. The temporary power outlet adapter of claim 12 wherein:

said first power outlet coupling is a twist type female connector.

14. The temporary power outlet adapter of claim 12 wherein:

said first power outlet coupling is a three prong female connector.

15. The temporary power outlet adapter of claim 12 further comprising:

a second power outlet coupling electrically connected to said splitter.

16. The temporary power outlet adapter of claim 15 wherein:

said second power outlet coupling is a twist type female connector.

17. The temporary power outlet adapter of claim 15 wherein:

said second power outlet coupling is a three prong female connector.

18. The temporary power outlet adapter of claim 15 wherein:

said splitter forms a Y split.

19. The temporary power outlet adapter of claim 15 wherein:

said splitter forms a W split.

20. A temporary power outlet adapter comprising:

a twist type male power coupling that is electrically connectable to a conventional temporary power distribution box;

a splitter electrically connected to said twist type male power coupling, wherein said splitter forms a Y split;

a household power outlet electrically connected to said splitter, said household power outlet integral to said splitter;

a first power outlet coupling electrically connected to said splitter, said first power outlet coupling is a twist type female connector; and a second power outlet coupling electrically connected to said splitter, said second power outlet coupling is a twist type female connector.

* * * * *